United States Patent [19]

Hain et al.

[11] 4,441,613

[45] Apr. 10, 1984

[54] CONTAINER WITH RESEALABLE CLOSURE

[75] Inventors: Paul O. Hain, Hamilton; J. George Lepisto, Middletown, both of Ohio

[73] Assignee: Champion International Corporation, Stamford, Conn.

[21] Appl. No.: 413,725

[22] Filed: Sep. 1, 1982

[51] Int. Cl.[3] ..... B65D 33/22

[52] U.S. Cl. ..... 206/621; 206/632; 206/633; 206/628; 383/85; 383/86

[58] Field of Search ..... 206/616, 618, 626, 632, 206/633, 628, 621; 383/85, 86; 229/17 G, 80

[56] References Cited

U.S. PATENT DOCUMENTS

| | | | |
|---|---|---|---|
| 1,957,777 | 5/1934 | Heath | 229/485 B |
| 1,985,326 | 12/1934 | Orr | 150/9 |
| 1,989,304 | 1/1935 | Andreas | 229/55 |
| 2,113,927 | 4/1938 | Alfred | 229/51 |
| 2,143,940 | 1/1939 | Craig et al. | 229/51 |
| 2,151,523 | 3/1939 | Orr | 229/66 |
| 2,203,924 | 6/1940 | Pletscher | 220/66 |
| 2,327,024 | 8/1943 | Davidson, Jr. et al. | 206/633 |
| 2,400,406 | 5/1946 | Godoy | 206/632 |
| 2,750,095 | 6/1956 | Alden | 229/17 G |
| 2,985,545 | 5/1961 | Leavitt | 117/143 |
| 2,987,234 | 6/1961 | Kieckhefer | 229/17 G |
| 3,011,691 | 12/1961 | McGlynn et al. | 229/86 |
| 3,074,610 | 1/1963 | Pugh | 229/17 G |
| 3,081,930 | 3/1963 | Owens | 229/66 |
| 3,308,996 | 3/1967 | Beck | 229/17 G |
| 3,426,936 | 2/1969 | Palmer | 220/53 |
| 3,648,922 | 3/1972 | Gebo | 229/62.5 |
| 3,702,171 | 11/1972 | Levine | 229/80 |
| 3,850,366 | 11/1974 | Saito | 206/616 |
| 3,893,460 | 7/1975 | Karami | 206/633 |
| 3,964,670 | 6/1976 | Amneus | 206/633 |
| 4,008,851 | 2/1977 | Hirsch | 383/62 |
| 4,260,061 | 4/1981 | Jacobs | 206/626 |
| 4,311,173 | 1/1982 | Sailors, Jr. | 141/68 |
| 4,316,574 | 2/1982 | Lepisto | 229/62.5 |

FOREIGN PATENT DOCUMENTS

| | | | |
|---|---|---|---|
| 867493 | 2/1953 | Fed. Rep. of Germany . | |
| 469192 | 5/1914 | France . | |
| 449402 | 4/1968 | Switzerland | 383/86 |
| 432821 | 8/1935 | United Kingdom . | |
| 868716 | 5/1961 | United Kingdom | 229/17 G |
| 891974 | 3/1962 | United Kingdom | 229/17 G |

*Primary Examiner*—Stephen P. Garbe
*Attorney, Agent, or Firm*—Evelyn M. Sommer

[57] ABSTRACT

A resealable bag for containing a flowable product comprises a plurality of panels hingedly coupled along fold lines, an opening at one end of the bag, a flap hingedly coupled to one panel along a fold line for overlapping an opposite panel and closing the opening, and a strip of adhesive tape for opening and resealing the flap. An adhesive layer extends across the entire width of the flap to seal the flap to the opposite panel. The adhesive layer seal can have a reduced bonding strength adjacent one end of the flap to facilitate opening of the flap at the reduced bond strength section. The reduced bonding strength is provided by an abhesive coating comprising kaolin clay. This arrangement is particularly useful in heavy weight bags which are sealed by a hot melt adhesive.

18 Claims, 8 Drawing Figures

CONTAINER WITH RESEALABLE CLOSURE

CROSS-REFERENCES TO RELATED APPLICATIONS

This application is related to Applicants' copending United States patent applications Ser. No. 419,736, filed Sept. 20, 1982, entitled "Container With Easy Opening Closure", and Ser. No. 413,972, filed Sept. 1, 1982, entitled "Bag Resealing Clip", which applications are incorporated herein by reference.

BACKGROUND OF THE INVENTION

1. Field of the Invention

The present invention relates to a container having a sealed flap closing one end of the container and a strip of pressure adhesive tape which is arranged on the container relative to the flap for lifting the flap to facilitate opening the container and for resealing the flap to the container.

2. Description of the Prior Art

Containers or bags formed of heavy weight, multiple ply paper are conventionally employed for containing, storing and shipping flowable, fine powdery materials and small sized granular products, such as starch, food products, chemicals, cement and the like. The flowable nature of these products permits the bags to be filled by inserting a filler spout of a dispensing machine into an opening of the bag and delivering the product from a source through the spout into the bag. The bag construction and filling apparatus for filling bags in this manner are disclosed in U.S. Pat. No. 4,316,574 to Lepisto, which patent is hereby incorporated by reference.

One problem which has plagued bags of this type is the provision of a simple and neat way to open the bags without using tools. Often heavy weight bags have no provision to facilitate opening and require the use of a sharp instrument to cut an opening in the bag. Such opening procedure is inconvenient and dangerous. Additionally, opening the bag using a sharp instrument often results in tearing of the bag preventing proper resealing for storing any remaining bag contents and preventing controlled dispensing of the contents.

Hand opening of conventional heavyweight bags sealed with hot melt adhesive is extremely difficult due to the strength of the bag material and the seal. Force applied to the closing flap will tear the bag since the bond between the adhesive and paper is stronger than the paper itself. Thus, hand opening of such bags is difficult, forms a poor dispensing spout, causes spilling of the contents, and prevents resealing of the bag.

Special mechanisms for opening bags have involved the use of strings, e.g., U.S. Pat. No. 2,203,924 to Pletscher and U.S. Pat. No. 2,151,523 to Orr, the inclusion of a glued tab, e.g., U.S. Pat. No. 3,081,930 to Owens and the use of tape, e.g., U.S. patent application Ser. No. 243,829, filed Mar. 16, 1981, entitled "Easy Open Valve Bag".

The previously tried closure opening mechanisms have suffered from numerous deficiencies, including a high failure rate, difficult and expensive manufacturing, adverse effects on the sealing of the bag and difficult operation. The string often fails by becoming loose from the bag without tearing the bag material and is difficult and expensive to install due to the precise gluing necessary. The thick material of the bag often makes the tab and tape mechanisms difficult to open. Additionally, such opening mechanisms provide a relatively large opening making controlled dispensing of the contents and resealing of the bag difficult.

Thus, previous systems for opening heavyweight bags for powder and granular substances have not been effective since they are difficult and expensive to manufacture, have a high failure rate, are difficult to operate and do not form a neat pouring spout for accurately dispensing the bag contents. Additionally, these systems make it extremely difficult or impossible to reseal the bag to properly store any unused contents in the bag, and have no provision for securely resealing the bag.

SUMMARY OF THE INVENTION

It has now been discovered that the disadvantages associated with conventional systems for opening containers closed by a sealed flap can be eliminated by the present invention which comprises a container seal including a strip of pressure sensitive adhesive tape which is attached to the container adjacent the flap for facilitating lifting the flap to initially open the container and for resealing the flap to close the container. The container has a body portion, an opening in the body portion providing access to the container interior, and a fold over flap hingedly coupled to the body portion for extending over and closing the opening. The flap is attachable to the body portion by the seal extending adjacent to and generally along the opening.

In this manner, the bag can be easily opened by applying force to an exposed, easily gripped portion of the tape to break the seal at the flap. The mechanical advantage and easy gripping of the tape facilitates separation of the flap. Additionally, the tape permits the container to be securely, quickly and simply resealed without using additional equipment or materials such that the container is self-equipped. The mounting of the tape can be accomplished simply and quickly without substantial modification to conventional container manufacturing processes and apparatus.

Preferably, the container is in the form of a bag having a plurality of panels hingedly coupled along fold lines, and opening at one end of the bag, and a flap hingedly coupled to one of the panels along a fold line for overlapping a portion of an opposite panel and closing the opening. A hot melt adhesive layer extends across the entire width of the flap for adhering the flap to the opposite panel and initially sealing the opening. The adhesive bonding strength of a first section of the hot melt adhesive layer is reduced by providing a spot coating of abherent (abhesive) comprising kaolin clay on the opposite panel portion corresponding to the first section of the adhesive layer. When the flap is folded and sealed in the conventional manner, the spot coating of abherent reduces, without eliminating, the adhesive bond strength of the seal between the flap and opposite panel at the first section adjacent one corner of the bag to permit the flap to be easily separated from the opposite panel portion. At the seal first section, separation occurs between the spot coating and the bag panel, rather than at an interface with the hot melt adhesive.

The pressure sensitive adhesive tape is preferably applied to the bag in one of two orientations. In each orientation the tape includes a first end portion adhered to the container and a second end portion with an adhesive surface covered by a removable abherent. In the first orientation, the first end portion is adhered to the opposite panel, and the second end portion extends parallel and between the fold-over flap fold line and the spot coating, extends beyond the bag and underlies the flap when initially sealed to the opposite panel. In the second orientation the first end portion is adhered to an exterior surface of the flap and the second end portion extends beyond the periphery of the flap such that the tape is perpendicular to the flap fold line. The flap is initially opened by gripping the exposed section of tape and then lifting to separate the flap from the opposite panel. The tape, after removal of the abherent, can be adhered to the flap and a bag panel to reseal the bag.

A line of perforations can be formed in the flap extending from the juncture of the adhesive layer first section and the remainder of the adhesive layer to the flap fold line. This permits the multiple plies of paper forming the bag and the flap to be easily separated in a neat and simple manner providing a pouring spout from which the bag contents can be accurately dispensed. The tape and first section can be located adjacent the corner of the bag opposite the filling valve means such that the formation of the easy opening system does not interfere with the formation and operation of the filling mechanism.

The spot coating can be printed, sprayed or brushed on the bag during its manufacture. In this manner, the reduced bond strength of the seal first portion is automatically formed during the conventional bag sealing process.

Other advantages and salient features of the present invention will become apparent from the following detailed description, which taken in conjunction with the annexed drawings, discloses preferred embodiments of the present invention.

DETAILED DESCRIPTION OF THE PREFERRED EMBODIMENT OF THE INVENTION

Figure 1:
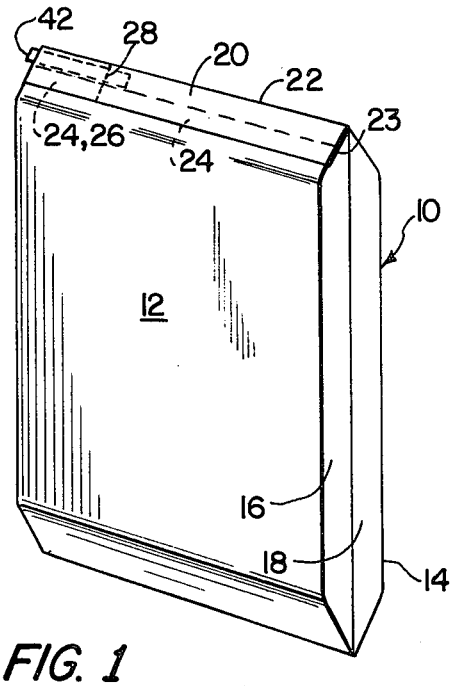
FIG. 1 is a perspective view of a bag in accordance with a first embodiment of the present invention.

Referring initially to FIG. 1, the bag 10 of the present invention is primarily intended to contain a flowable matter comprising powdery or granular products, such as starch, food products, chemicals, cement and the like. The bag comprises a plurality of panels which are hingedly coupled along fold lines. Specifically, the bag has parallel front and back panels 12 and 14 joined at each side thereof by a pair of hingedly coupled side panels 16 and 18. A flap 20 is hingedly coupled to the one edge of back panel 14 along fold line 22. When folded over and adhered to front panel 12, flap 20 closes and seals the opening in bag 10 between the front, back and side panels at one end. A similar flap is provided at the oppsite end of bag 10 to close the other opening of the bag.

At one corner of bag 10, a suitable filling valve 23 is provided of the type disclosed in U.S. Pat. No. 4,316,574 to Lepisto. Since such valve is fully and adequately disclosed in the Lepisto patent, no further discussion thereof will be provided.

Flap 20 is adhered and sealed to panel 12 by a layer 24 of conventional hot melt adhesive formed on the inner surface of the flap adjacent its distal edge, i.e., remote from fold line 22. Layer 24 extends the entire width of flap 22 in order to completely seal the bag.

A spot coating 26 of suitable adhesive material is formed on the exposed surface of front panel 12. The material of coating 26 upon being heat sealed to the hot melt adhesive layer 24 will reduce the adhesion of the hot melt adhesive coated flap to the abhesive coated panel at a first section thereof which is co-extensive with spot coating 26. Although the spot coating reduces the bond strength at the location thereof, it does not totally eliminate the bond strength so as to provide a seal thereat.

Preferably, the abhesive material of coating 26 should have a fine particle size providing a large surface area capable of reducing the effectiveness of the hot melt adhesive and should have a laminated plate structure, as opposed to a crystal structure such as calcium carbonate. Additionally, the abhesive should be capable of being printed in combination with other materials by flexography and should be inert and/or of food grade material such that the bag can be used to contain food. Also, the adhesive should have very weak adhesion such that it will have enough dry integrity to resist dusting, but will split from the cellulose bag material. Finally, the abhesive material should have easily controlled release characteristics, i.e., relatively large changes in the quantity of material applied will have a relatively minor effect on the release qualities of the coating. The preferred abhesive of the present invention comprises kaolin clay.

The material should be applied in combination with a viscosity modifier, thickener or the like. Bentonite is preferred for such purpose. The addition of such material will reduce settling and facilitate application of the material by flexoprinting.

Other materials which may be used for abhesive coating 26 include, for example, silicones, fluoro chemicals and finally ground pearl starch. Although the silicones and fluoro chemicals function excellently to reduce the adhesion of the hot melt adhesive-coated flap to the abhesive-coated panel, such materials are disadvantageous due to their high cost.

A line of perforations 28 is formed in fold-over flap 20 such that it extends perpendicularly from and between the distal edge of flap 20 and fold line 22. The perforations are spaced from the adjacent corner of the bag a distance equal to the length of spot coating 26. As will be explained in greater detail hereinafter, the line of perforations facilitate tearing of the flap to form a neat pouring spout for dispensing the bag contents.

The bag is formed from multiple plies of paper in a conventional manner. In the illustrated embodiment, each panel has three plies. Additionally, a ply formed of a film of synthetic plastic material can be provided as an innermost ply which is suitably adhered to the innermost paper ply as required depending on the intended contents of the bag. The ends of the plies forming flap 20 are staggered or shingled as illustrated. Thus, the flap includes an outer back ply 30, a middle back ply 32 and an inner back ply 34. The top portion of front panel 12 extends above fold line 22, which top portion is defined by the shingled plies including an outer front ply 36, a middle front ply 38 and an inner front ply 40. Access to the bag interior is obtained by separating inner plies 34 and 40. Since the top portion of upper panel 12 extends above fold line 22 and is partially coated by adhesive layer 24, the bag is securely sealed upon closing and sealing of flap 20 such that the bag contents will not sift or otherwise escape from the bag.

Figure 2:
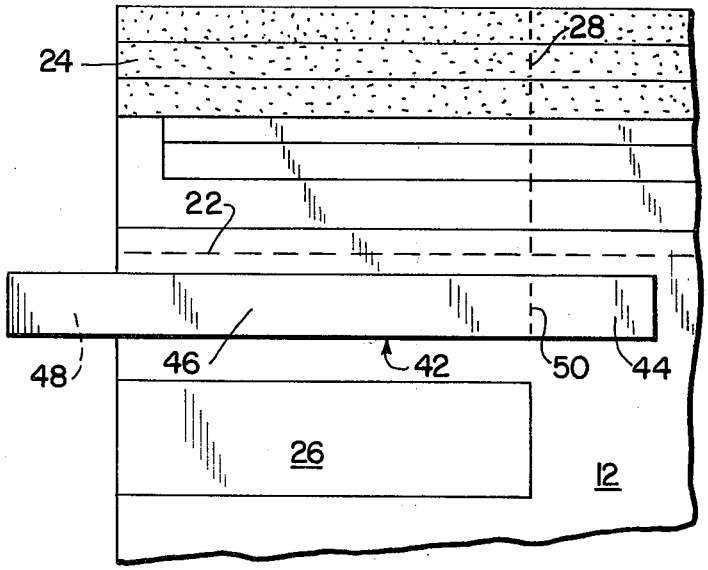
FIG. 2 is a partial, enlarged top plan view of the bag of FIG. 1 prior to folding and sealing of the flap to close the bag opening.

According to the first embodiment of the present invention, a strip of strong, pressure sensitive adhesive tape 42, e.g., fiberglass reinforced polyester pressure sensitive tape, is attached to bag 10 adjacent perforation line 28 in flap 20. The tape has a first end portion 44 (approximately 1½ to 2 inches long) adhered to front panel 12, and a second end portion extending substantially parallel and between fold line 22 and abhesive coating 26, and beyond the periphery of flap 20 and front panel 12 by approximately one inch. The normally tacky adhesive surface of the tape second end portion is covered by a removable abherent 48, preferably a sheet of release paper. When the bag is initially sealed, the tape is located on front panel 12 such that the tape underlies flap 20 and the juncture 50 of the tape end portions is aligned with perforation line 28 as illustrated in FIG. 2. Thus, the tape extends to both sides of line 28.

To open the originally sealed bag, the exposed end of tape 42 is gripped with the fingers and is pulled outwardly. As the tape is pulled, it engages the inner surface of flap 20 adjacent the seal section of reduced bonding strength and lifts and separates a portion of flap 20 from front panel 20. The flap can then be easily separated along line 28 to form a neat pouring spout.

Figure 4:
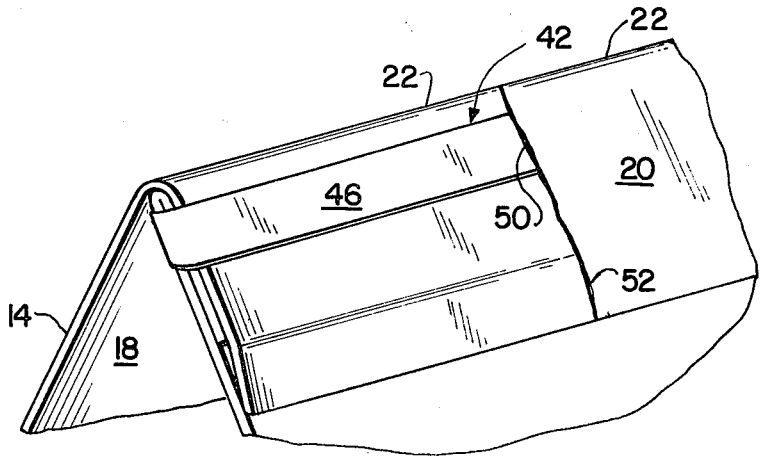
FIG. 4 is a partial, enlarged perspective view of the bag of FIG. 1 after it has been resealed.

The flap is resealed by refolding it along fold line 22. As illustrated in FIG. 4, tape second end portion 46 is threaded through the slit 52 formed by the tearing of flap 20 along perforation line 28. Thereafter, abherent 48 is removed and the tape second end portion is adhered to the outer surface of flap 20, over the edge of the flap and front panel 12, and to side panel 16. With the tape resealing the bag, the contents can be safely stored for later use. The bag can be resealed several times before its adhesive is exhausted.

The second embodiment of the invention is illustrated in FIGS. 5–8. In bag 110, first end portion 144 of tape 142 is adhered to the exterior surface flap 20, and extends perpendicular to fold line 22 and between perforation line 28 and the adjacent corner of bag 110. The second end portion 146 extends beyond the distal edge of flap 20, i.e., the edge remote from fold line 22, and has its normally tacky adhesive surface covered by a removable abherent 148. Preferably, the abherent is a sheet of release paper.

Figure 5:
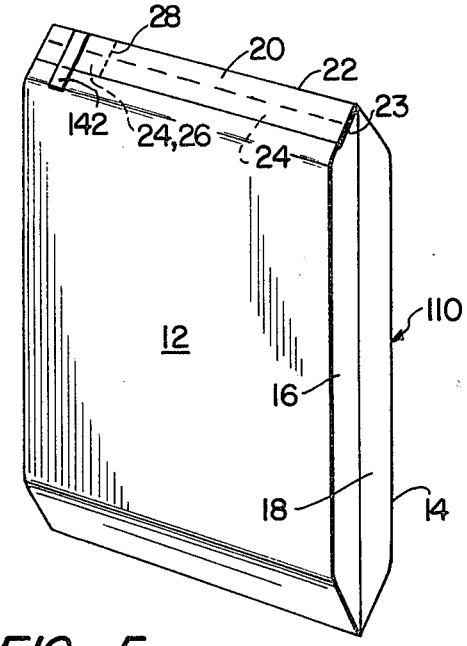
FIG. 5 is a perspective view of a bag in accordance with a second embodiment of the present invention.
Figure 7:
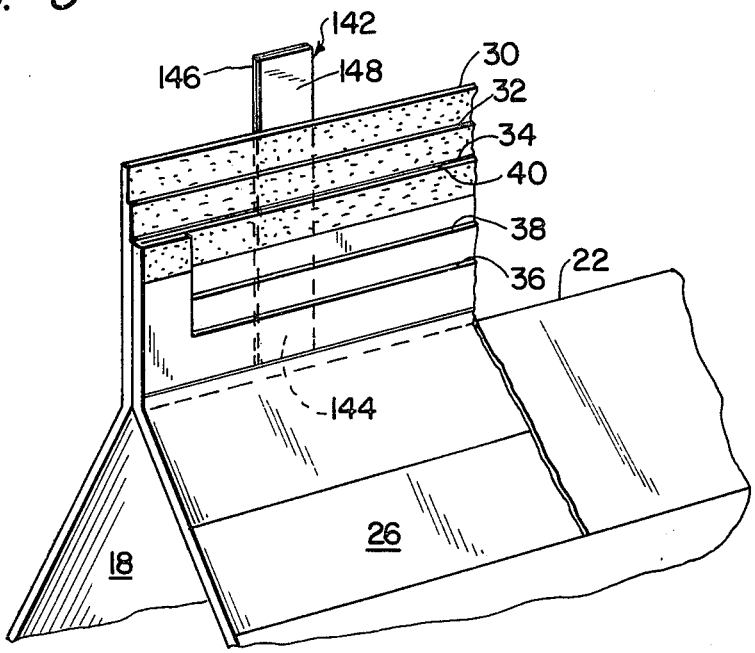
FIG. 7 is a partial, enlarged perspective view of the bag of FIG. 5 after it has been opened.
Figure 8:
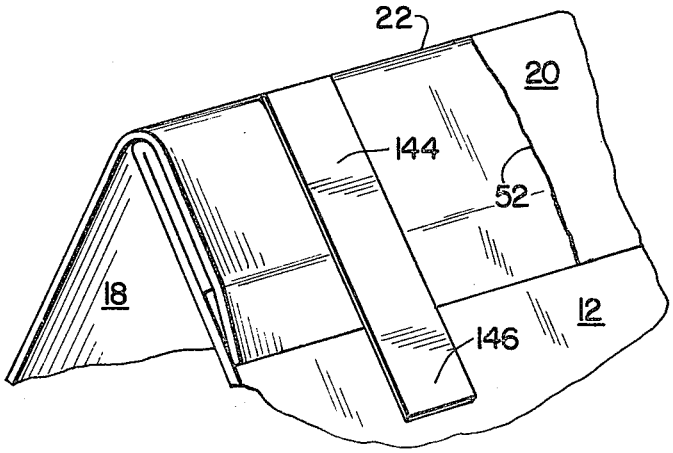
FIG. 8 is a partial, enlarged perspective view of the bag of FIG. 5 after it has been resealed.

The originally sealed bag 110 illustrated in FIG. 5 is opened by gripping end portion 146 and then lifting and tearing flap 20 along perforation line 28 to separate a portion of flap 20 from panel 12 as illustrated in FIG. 7. As illustrated in FIG. 8, bag 110 is resealed by refolding flap 20 along fold line 22, removing abherent 148 and adhering second end portion 142 to front panel 12.

Figure 6:
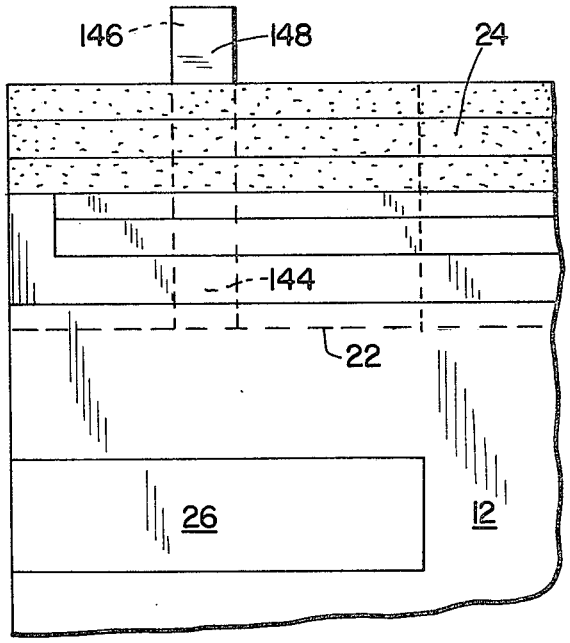
FIG. 6 is a partial, enlarged top plan view of the bag of FIG. 5 prior to folding and sealing of the flap to close the bag opening.

The bag of the present invention is basically formed in a conventional manner from a plurality of paper plies with a layer of adhesive 24 formed on the inner surface of flap 20 at its distal edge. Line 28 of perforations is formed in flap 20 and the portion of front panel 12 extending above fold line 22 spaced a distance (approximately 3 to 4 inches) from one corner of the bag as illustrated in FIGS. 2 and 6. A spot coating is printed, sprayed or brushed on front panel 12 adjacent the same corner from the edge of the front panel for a distance corresponding to the spacing of the line 28 from the corner. The spot coating is spaced below fold line 22 a distance corresponding to the spacing of adhesive layer 24 therefrom such that layer 24 and coating 26 will overlap upon folding of flap 20 about line 22. Additionally, tape 42 or 142 is applied as illustrated in FIGS. 2 or 6, respectively. Thus, except for the formation of perforation line 28 and spot coating 26 and the mounting of tape 42 or 142, bag 10 of the present invention is formed in a conventional manner.

Figure 3:
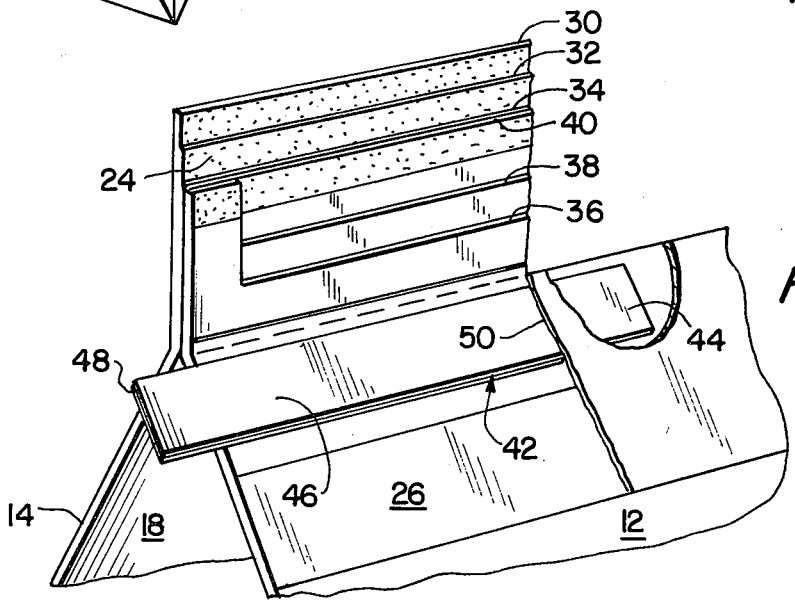
FIG. 3 is a partial, enlarged perspective view of the bag of FIG. 1 after it has been opened.

Upon adhering flap 20 to panel 12, a highly effective seal is provided for the bag. The bag can be easily opened by hand by gripping tape 42 or 142. The reduced bond strength of the hot melt adhesive resulting from the provision of coating 26 and the mechanical advantage provided by the tape causes the flap to separate easily from panel 12 along the spot coating and tear along the line of perforations to form the configuration illustrated in FIGS. 3 and 7. By separating inner plies 34 and 40 and extending the folded-in side panels 16 and 18, a neat and highly effective spout is formed from which the bag contents can be accurately dispensed. Since a neat, small opening is formed in the bag, it may be reclosed by refolding the raised portion of flap 20 and then resealed by tape 42 or 142 such that the remaining contents in the bag can be safely stored.

Although the invention has been described in considerable detail, with particular reference to certain preferred embodiments thereof, variations and modifications can be effected within the scope and spirit of the invention as defined in the appended claims.

What is claimed is:

1. A resealable container which comprises:

a body portion having an opening at one end thereof providing access to the container interior;

a fold-over flap hingedly coupled to said body portion along a fold line for extending over and closing said opening, said flap being attachable to said body portion by seal means extending adjacent to and generally along said opening;

means for lifting and resealing said flap including a strip of pressure adhesive tape having a first end portion adhered to the container and second end portion having an adhesive surface covered by a removable abherent;

whereby said tape engages and separates said flap from said body portion when lifted, and said tape reseals said flap after opening by adhering to said flap and body portion upon removal of said abherent.

2. A resealable container according to claim 1 wherein said abherent comprises a release sheet.

3. A resealable container according to claim 1 wherein said tape first end portion is adhered to said body portion; and said tape second end portion extends substantially parallel to said fold line and underlies said flap when said flap is initially sealed to said body portion.

4. A resealable container according to claim 3 wherein said tape second end portion extends beyond said flap and body portion to facilitate gripping.

5. A resealable container according to claim 1 wherein said tape first end portion is adhered to an exterior surface of said flap and said tape second end portion extends beyond the periphery of said flap.

6. A resealable container according to claim 5 wherein said tape extends substantially perpendicular to said fold line.

7. A resealable container according to claim 1 wherein said seal means comprises longitudinally spaced, first and second sections with said first section attaching said flap to said body portion with an adhesive bonding strength less than that of said second section, said tape engaging said flap adjacent said first section.

8. A resealable container according to claim 7 wherein said flap is weakened along a line extending angularly relative to said seal means from the juncture of said first and second sections to said fold line.

9. A bag for containing a flowable product, which comprises:

a plurality of panels hingedly coupled along fold lines;

an opening at one end of the bag;

a flap hingedly coupled to one of said panels along a fold line for overlapping a portion of an opposite panel and closing said opening;

an adhesive layer on and extending across the entire width of said flap for adhering said flap to said opposite panel to seal said opening;

a spot coating of abhesive means on said opposite panel for partially reducing, but not eliminating, the adhesive bonding strength of said adhesive layer on a first section thereof adjacent one corner of said bag to facilitate opening of said flap, while maintaining a seal at said first section prior to opening; and means for lifting and resealing said flap including a strip of pressure sensitive adhesive tape adjacent said abhesive layer first section.

10. A bag according to claim 9 wherein said tape comprises a first end portion adhered to said opposite panel and a second end portion extending substantially parallel and between said fold line and said spot coating, and underlying said flap when initially sealed to said opposite panel.

11. A bag according to claim 10 where said tape second end portion has an adhesive surface covered by a removable abherent.

12. A bag according to claim 10 wherein said tape second end portion extends beyond the periphery of said flap.

13. A bag according to claim 10 wherein said flap has a line of perforations extending from the juncture of said adhesive layer first section and the remainder thereof to said fold line; and said tape first end portion is adhered to said opposite panel on a side of said line of perforations remote from said one corner.

14. A bag according to claim 9 wherein said tape has a first end portion adhered to an exterior surface of said flap and a second end portion extending beyond the periphery of said flap.

15. A bag according to claim 14 wherein said tape extends perpendicularly relative to said fold line.

16. A bag according to claim 14 wherein said tape second end portion has an adhesive surface covered with a removable abherent.

17. A bag according to claim 9 wherein filling valve means are formed in the bag adjacent said one end and at a corner opposite said adhesive layer first section.

18. A bag according to claim 9 wherein said panels are formed of multiple plies of paper.

* * * * *